US006390824B1

(12) United States Patent
Vance

(10) Patent No.: US 6,390,824 B1
(45) Date of Patent: May 21, 2002

(54) MULTIPLE POWER ADAPTER INTERFACE APPARATUS

(76) Inventor: Kenneth M. Vance, P.O. Box 126, Gary, WV (US) 24836-0126

( * ) Notice: Subject to any disclaimer, the term of this patent is extended or adjusted under 35 U.S.C. 154(b) by 0 days.

(21) Appl. No.: 09/976,738

(22) Filed: Oct. 12, 2001

Related U.S. Application Data

(62) Division of application No. 09/636,604, filed on Aug. 11, 2000, now Pat. No. 6,305,945.

(51) Int. Cl.[7] ..... H01R 33/00; H01R 27/00
(52) U.S. Cl. ..... 439/35; 439/218
(58) Field of Search ..... 439/35, 218, 34, 439/650, 668, 675; 362/80

(56) References Cited

U.S. PATENT DOCUMENTS

| | | | | |
|---|---|---|---|---|
| 4,057,310 A | | 11/1977 | Young | |
| 4,800,471 A | | 6/1989 | Lippert | |
| 4,846,697 A | | 7/1989 | Rodgers | |
| 5,281,147 A | | 1/1994 | Hughes | |
| 5,514,009 A | | 5/1996 | Hughes | |
| 5,611,695 A | * | 3/1997 | Bentley | 439/131 |
| 5,766,020 A | | 6/1998 | Hughes | |
| 6,024,590 A | * | 2/2000 | Mackowiak et al. | 439/247 |
| 6,036,530 A | * | 3/2000 | Edwards et al. | 174/153 G |
| 6,305,945 B1 | * | 10/2001 | Vance | 439/218 |

* cited by examiner

*Primary Examiner*—Brian Sircus
*Assistant Examiner*—Chandrika Prasad

(57) ABSTRACT

A multiple power adapter interface apparatus for allowing the user to attach essentially any type of trailer to the power adapter interface apparatus without having to splice wires. The multiple power adapter interface apparatus includes a mounting bracket for mounting to a vehicle; and also includes one or more electrical terminals securely mounted to the mounting bracket and each having a plurality of connecting members for connecting to a plug of an electrically-operated device with the one or more electrical terminals also having second connecting members for connecting to a plug of a power source; and further includes a bracket member depending from the one or more electrical terminals; and also includes at least one electrical outlet securely mounted to the bracket member; and further includes at least one cover member being hingedly attached to the bracket member and being coverable upon the at least one electrical outlet; and also includes a plurality of wires connected to the at least one electrical outlet and being adapted to be connected to a power supply.

19 Claims, 8 Drawing Sheets

MULTIPLE POWER ADAPTER INTERFACE APPARATUS

REFERENCE TO RELATED APPLICATION

This application is a divisional of Application Ser. No. 09/636,604, filed Aug. 11, 2000, now U.S. Pat. No. 6,305,945.

BACKGROUND OF THE INVENTION

1. Field of the Invention

The present invention relates to a trailer quick connect device and more particularly pertains to a new multiple power adapter interface apparatus for allowing the user to attach essentially any type of trailer to the power adapter interface apparatus without having to splice wires.

2. Description of the Prior Art

The use of a trailer quick connect device is known in the prior art. More specifically, a trailer quick connect device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,057,310; 5,766,020; 4,800,471; 5,514,009; 4,846,697; and 5,281,147.

While these devices fulfill their respective, particular objectives and requirements, the aforementioned patents do not disclose a new multiple power adapter interface apparatus. The inventive device includes a mounting bracket for mounting to a vehicle; and also includes one or more electrical terminals securely mounted to the mounting bracket and each having a plurality of connecting members for connecting to a plug of an electrically-operated device with the one or more electrical terminals also having second connecting members for connecting to a plug of a power source; and further includes a bracket member depending from the one or more electrical terminals; and also includes at least one electrical outlet securely mounted to the bracket member; and further includes at least one cover member being hingedly attached to the bracket member and being coverable upon the at least one electrical outlet; and also includes a plurality of wires connected to the at least one electrical outlet and being adapted to be connected to a power supply.

In these respects, the multiple power adapter interface apparatus according to the present invention substantially departs from the conventional concepts and designs of the prior art, and in so doing provides an apparatus primarily developed for the purpose of allowing the user to attach essentially any type of trailer to the power adapter interface apparatus without having to splice wires.

SUMMARY OF THE INVENTION

In view of the foregoing disadvantages inherent in the known types of trailer quick connect device now present in the prior art, the present invention provides a new multiple power adapter interface apparatus construction wherein the same can be utilized for allowing the user to attach essentially any type of trailer to the power adapter interface apparatus without having to splice wires.

The general purpose of the present invention, which will be described subsequently in greater detail, is to provide a new multiple power adapter interface apparatus which has many of the advantages of the trailer quick connect device mentioned heretofore and many novel features that result in a new multiple power adapter interface apparatus which is not anticipated, rendered obvious, suggested, or even implied by any of the prior art trailer quick connect device, either alone or in any combination thereof.

To attain this, the present invention generally comprises a mounting bracket for mounting to a vehicle; and also includes one or more electrical terminals securely mounted to the mounting bracket and each having a plurality of connecting members for connecting to a plug of an electrically-operated device with the one or more electrical terminals also having second connecting members for connecting to a plug of a power source; and further includes a bracket member depending from the one or more electrical terminals; and also includes at least one electrical outlet securely mounted to the bracket member; and further includes at least one cover member being hingedly attached to the bracket member and being coverable upon the at least one electrical outlet; and also includes a plurality of wires connected to the at least one electrical outlet and being adapted to be connected to a power supply.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple power adapter interface apparatus which has many of the advantages of the trailer quick connect device mentioned heretofore and many novel features that result in a new multiple power adapter interface apparatus which is not anticipated, rendered obvious, suggested, or even implied by any of the prior art trailer quick connect device, either alone or in any combination thereof.

It is another object of the present invention to provide a new multiple power adapter interface apparatus which may be easily and efficiently manufactured and marketed.

It is a further object of the present invention to provide a new multiple power adapter interface apparatus which is of a durable and reliable construction.

An even further object of the present invention is to provide a new multiple power adapter interface apparatus which is susceptible of a low cost of manufacture with regard to both materials and labor, and which accordingly is then susceptible of low prices of sale to the consuming public, thereby making such multiple power adapter interface apparatus economically available to the buying public.

Still yet another object of the present invention is to provide a new multiple power adapter interface apparatus which provides in the apparatuses and methods of the prior art some of the advantages thereof, while simultaneously overcoming some of the disadvantages normally associated therewith.

Still another object of the present invention is to provide a new multiple power adapter interface apparatus for allowing the user to attach essentially any type of trailer to the power adapter interface apparatus without having to splice wires.

Yet another object of the present invention is to provide a new multiple power adapter interface apparatus which includes a mounting bracket for mounting to a vehicle; and also includes one or more electrical terminals securely mounted to the mounting bracket and each having a plurality of connecting members for connecting to a plug of an electrically-operated device with the one or more electrical terminals also having second connecting members for connecting to a plug of a power source; and further includes a bracket member depending from the one or more electrical terminals; and also includes at least one electrical outlet securely mounted to the bracket member; and further includes at least one cover member being hingedly attached to the bracket member and being coverable upon the at least one electrical outlet; and also includes a plurality of wires connected to the at least one electrical outlet and being adapted to be connected to a power supply.

Still yet another object of the present invention is to provide a new multiple power adapter interface apparatus that gives the user ready access to 12-volt electrical outlets when needed.

Even still another object of the present invention is to provide a new multiple power adapter interface apparatus that is easy and convenient to install and saves the user substantial time when hitching to a trailer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
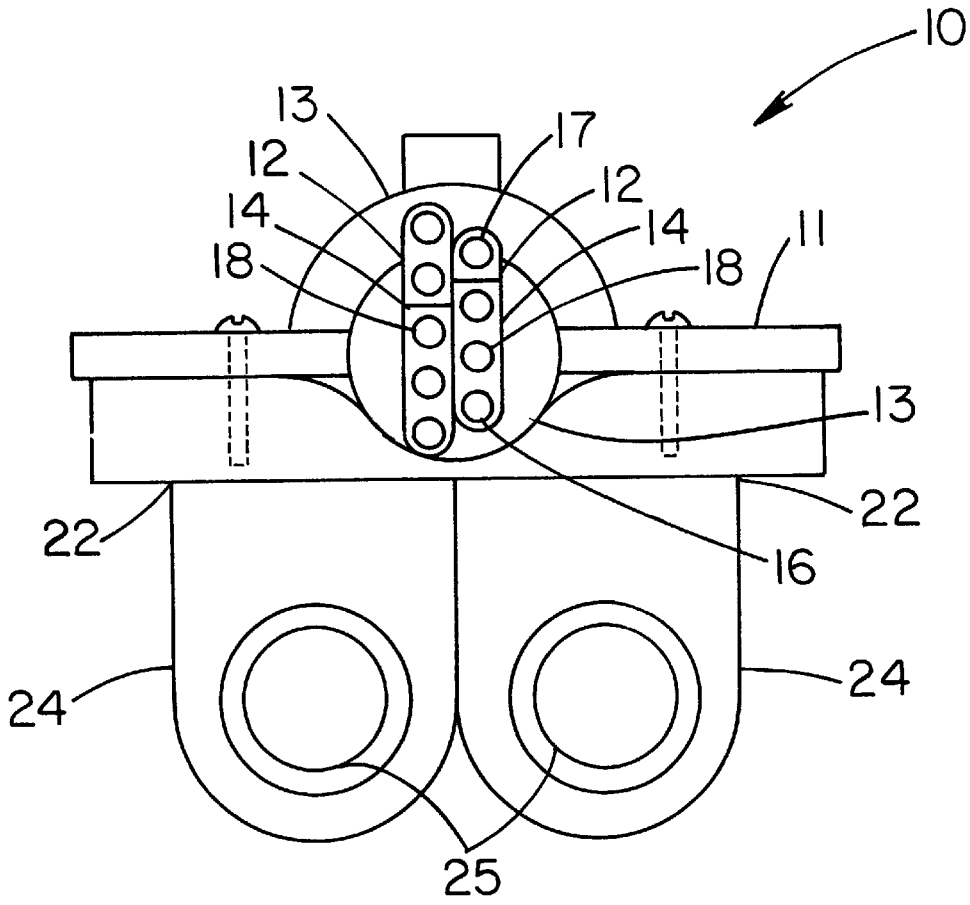
FIG. 1 is a first side elevational view of a first embodiment of a new multiple power adapter interface apparatus according to the present invention.
Figure 2:
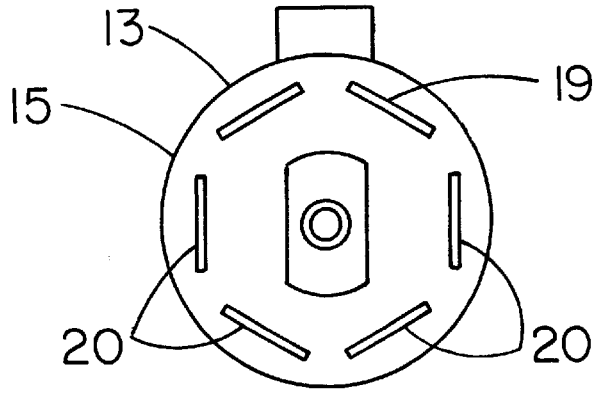
FIG. 2 is a second side elevational view of the first embodiment of the second connecting members of the present invention.
Figure 3:
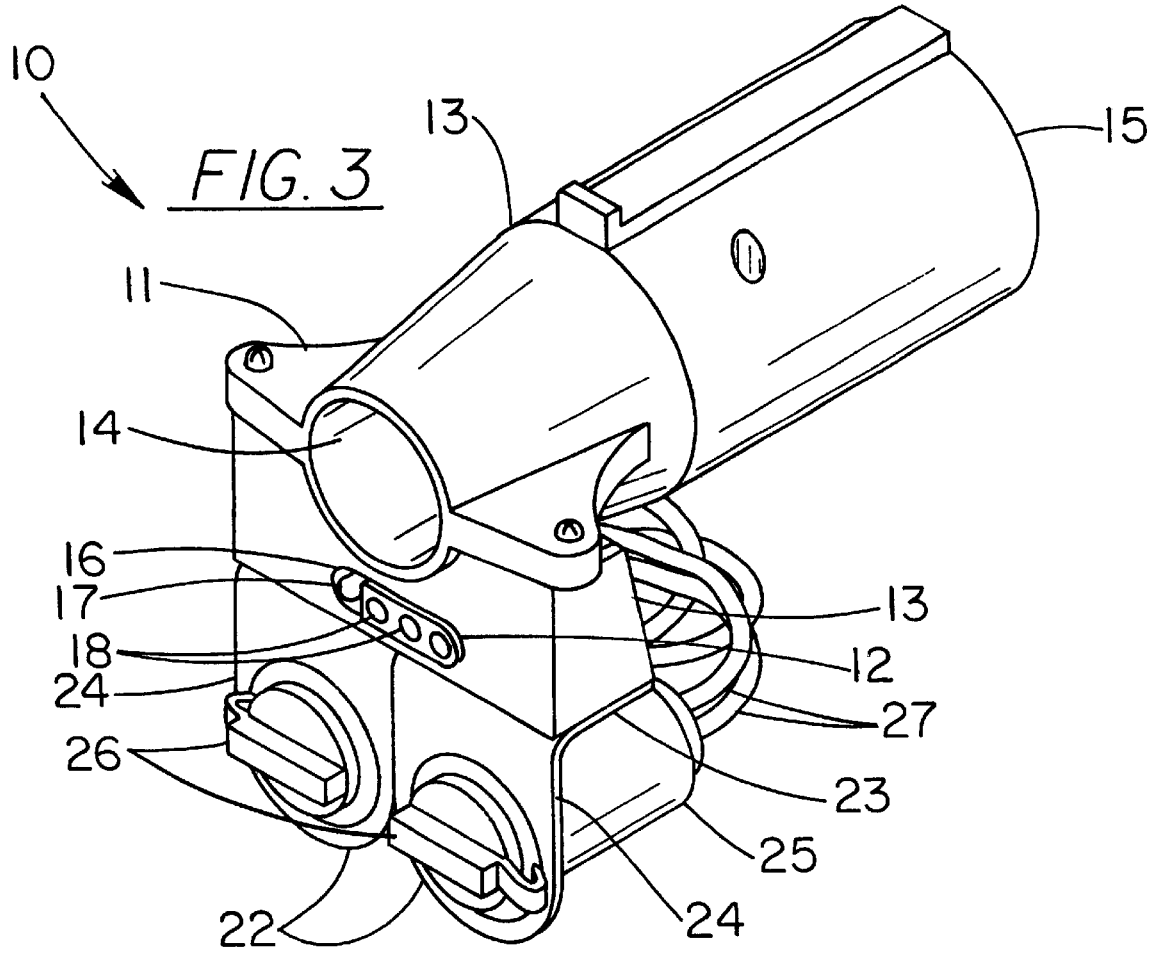
FIG. 3 is a first side perspective view of a second embodiment of the present invention.
Figure 4:
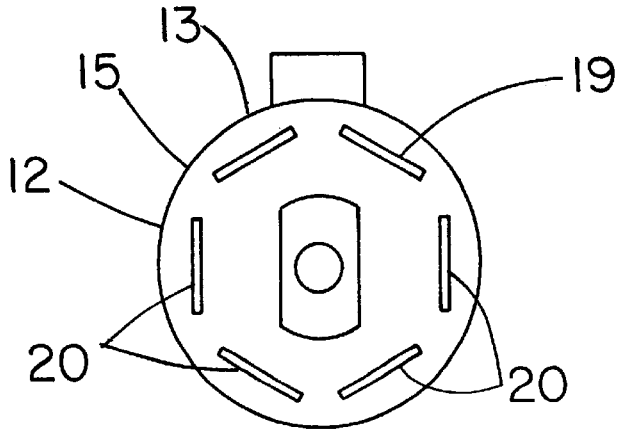
FIG. 4 is a second side elevational view of the second embodiment of the present invention.
Figure 5:
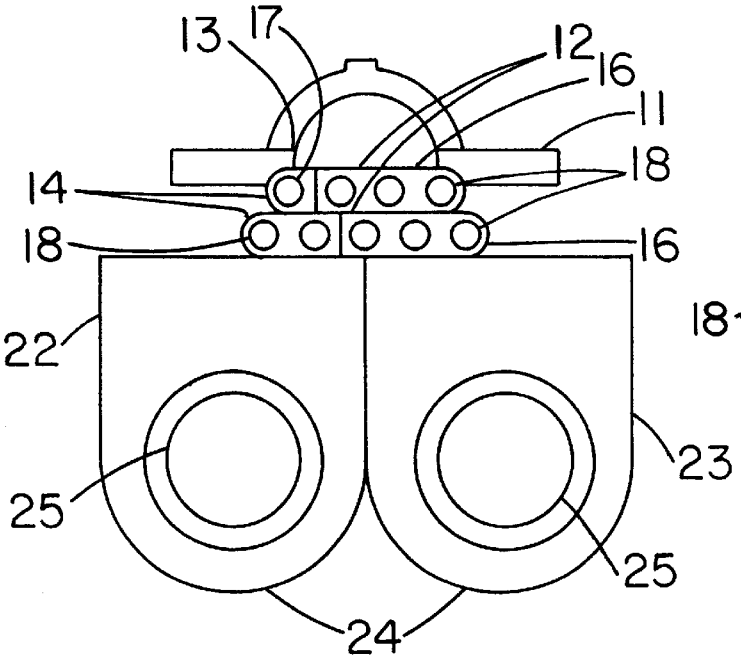
FIG. 5 is a first side elevational view of a third embodiment of the embodiments of the present invention.
Figure 6:
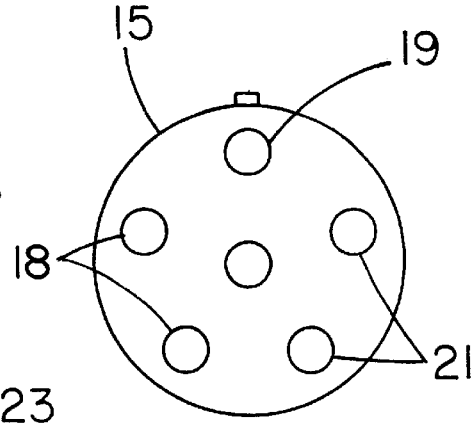
FIG. 6 is a second side elevational view of the third and a ninth embodiments of the present invention.
Figure 7:
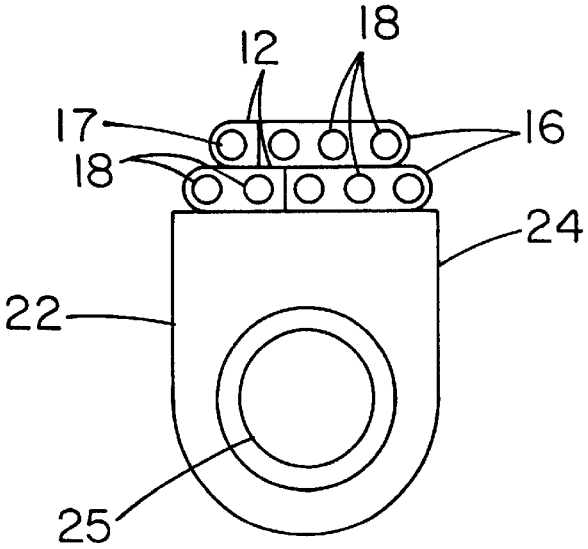
FIG. 7 is a first side elevational view of a fourth embodiment of the present invention.
Figure 8:
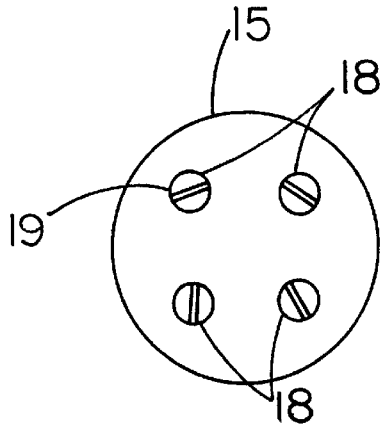
FIG. 8 is a second side elevational view of the fourth embodiment of the present invention.
Figure 9:
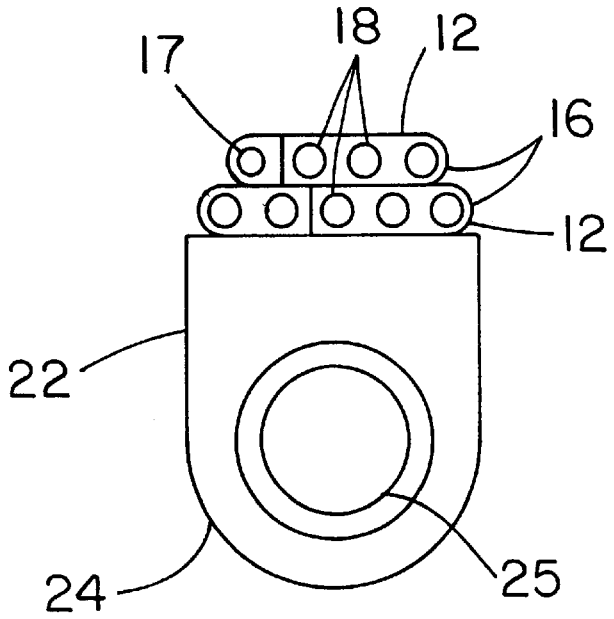
FIG. 9 is a first side elevational view of a fifth embodiment of the present invention.
Figure 10:
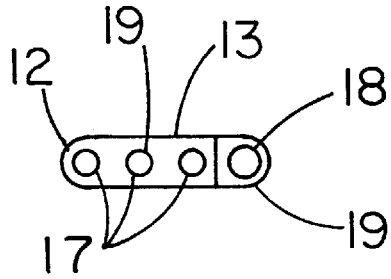
FIG. 10 is a second elevational view of the fifth, seventh, and eighth embodiments of the present invention.
Figure 11:
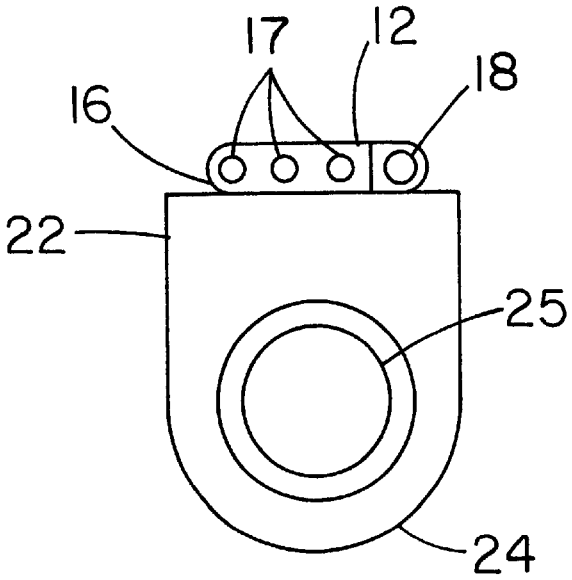
FIG. 11 is a first side elevational view of a sixth embodiment of the present invention.
Figure 12:
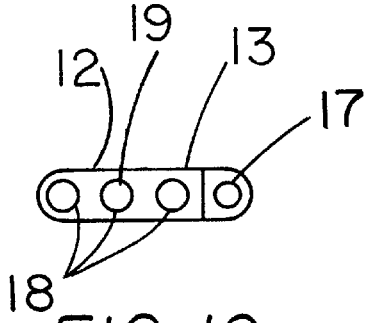
FIG. 12 is a second side elevational view of the sixth embodiment of the present invention.
Figure 13:
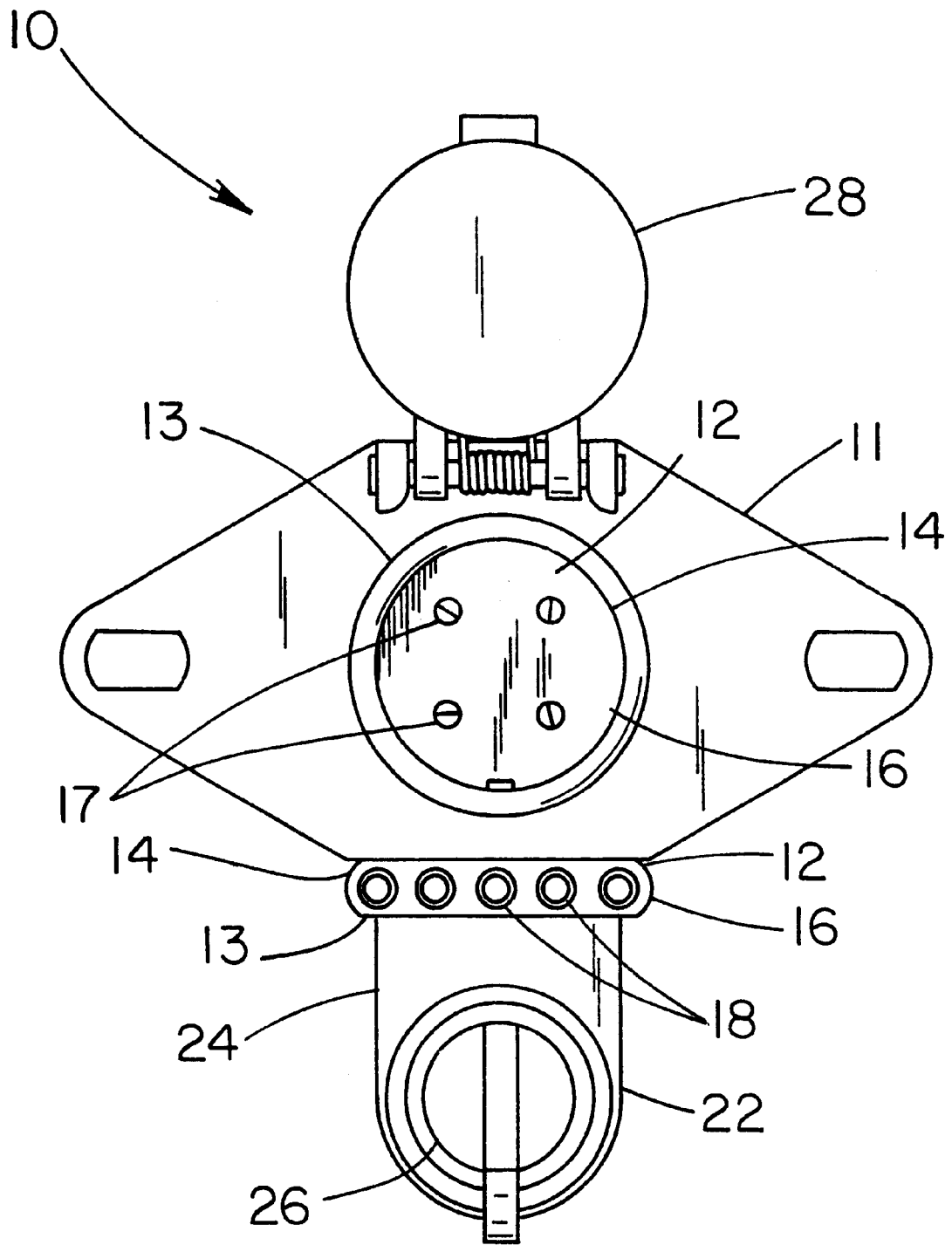
FIG. 13 is a first side elevational view of a seventh embodiment of the present invention.
Figure 14:
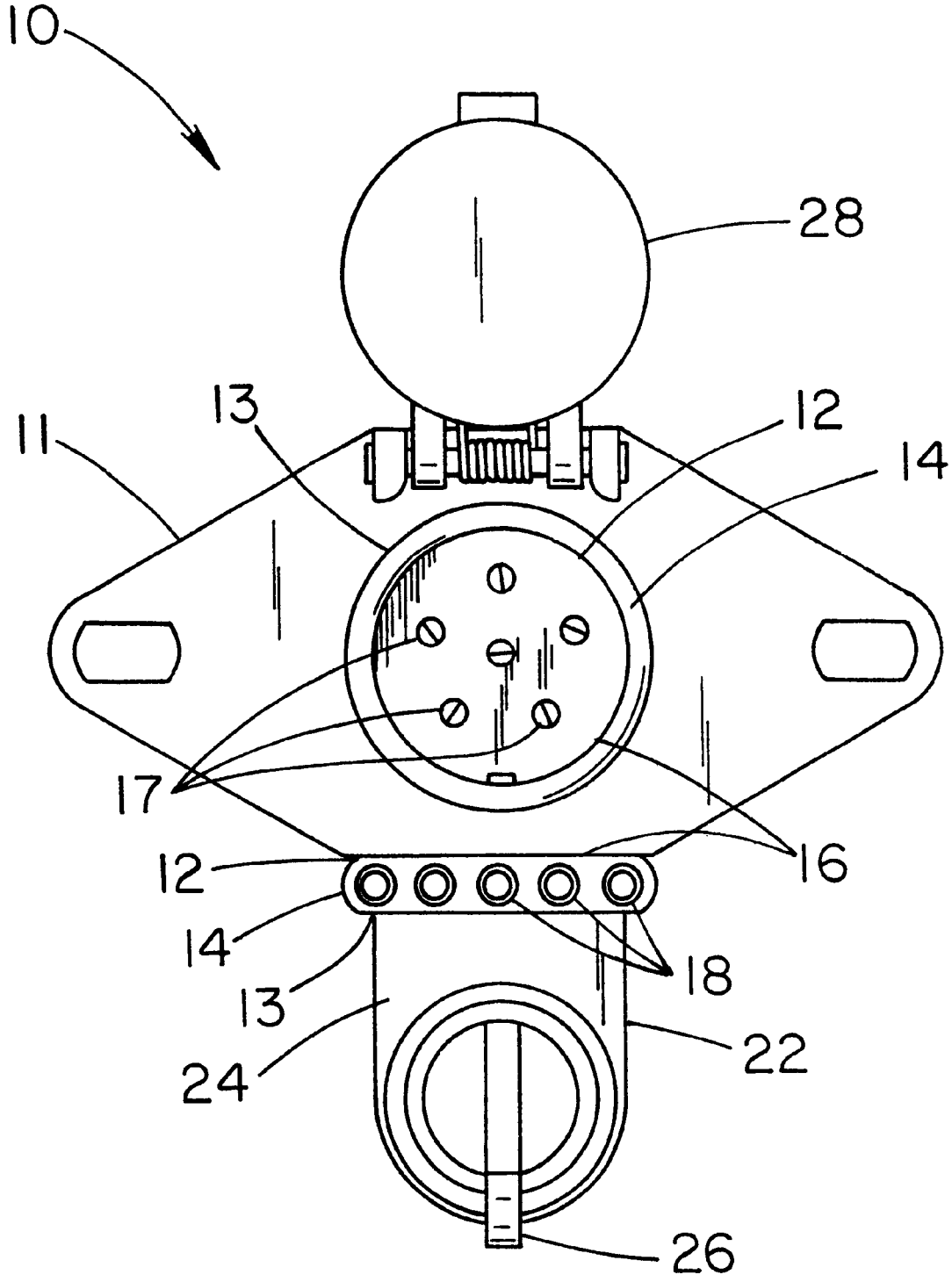
FIG. 14 is a first side elevational view of an eighth embodiment of the present invention.
Figure 15:
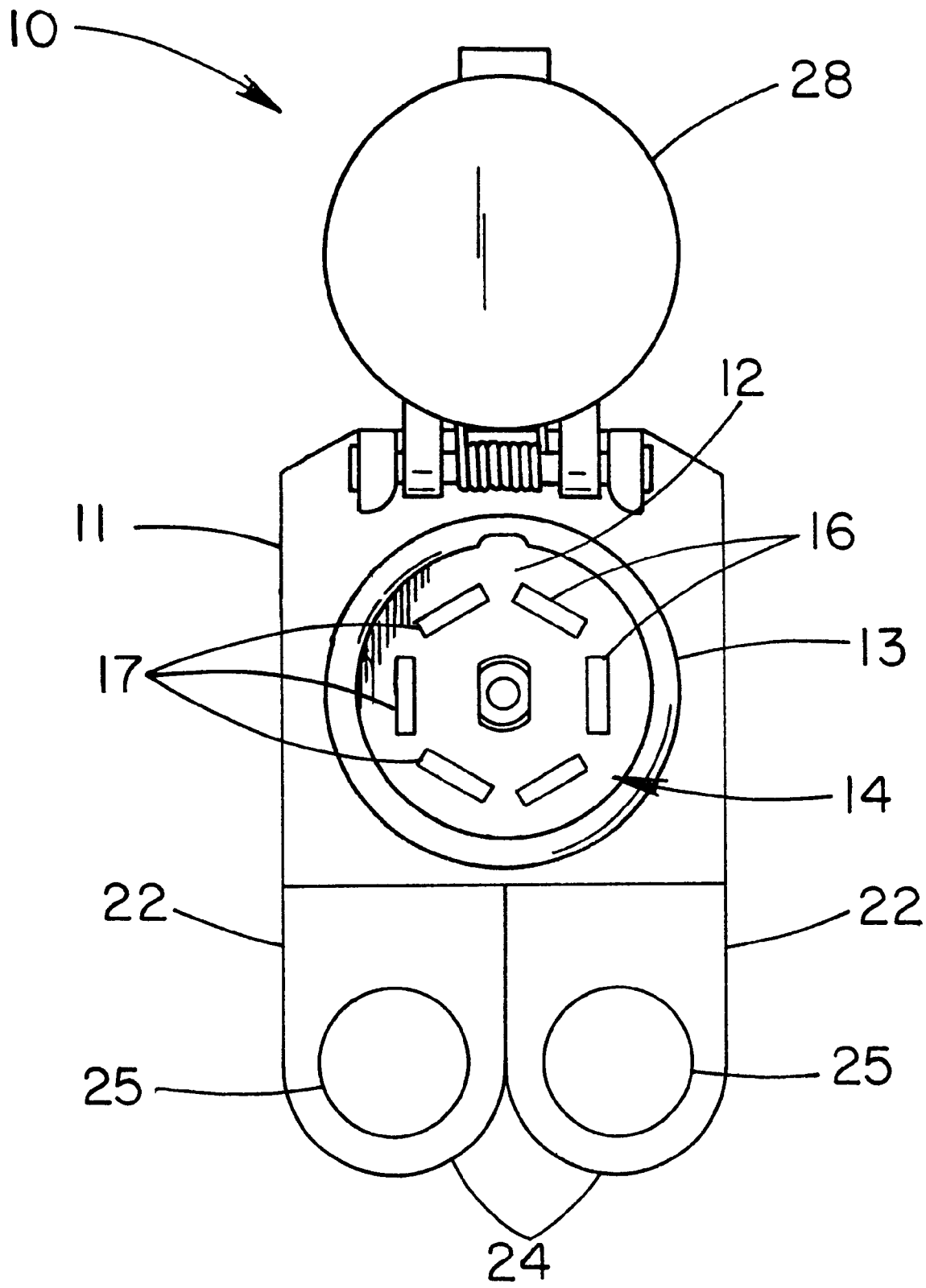
FIG. 15 is a first side view of a ninth embodiment of the present invention.
Figure 16:
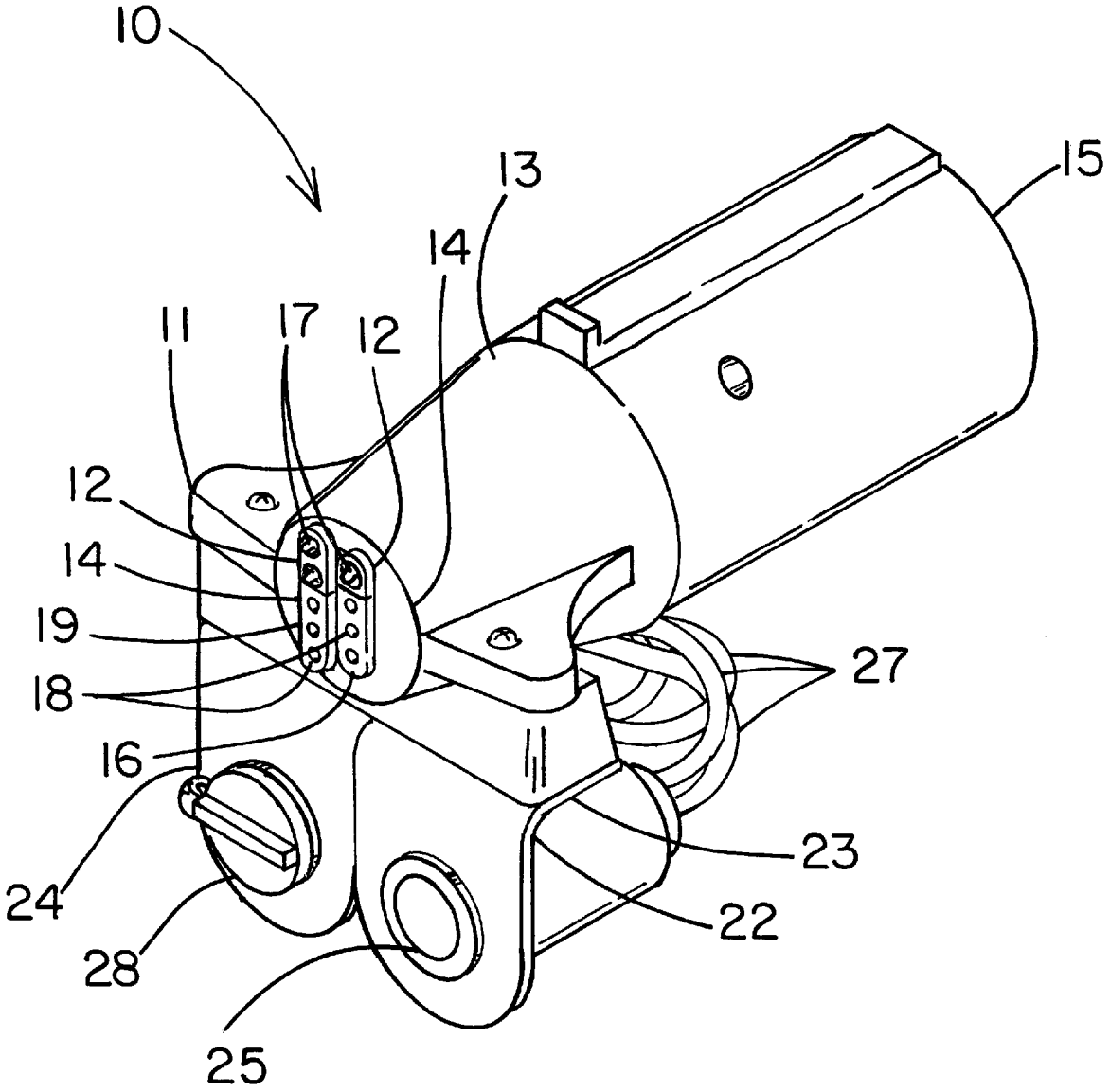
FIG. 16 is schematic perspective view of the embodiment of the present invention shown in FIGS. 1 and 2.

With reference now to the drawings, and in particular to FIGS. 1 through 16 thereof, a new multiple power adapter interface apparatus embodying the principles and concepts of the present invention and generally designated by the reference numeral 10 will be described.

As best illustrated in FIGS. 1 through 16, the multiple power adapter interface apparatus 10 generally comprises a mounting bracket 11 for mounting to a vehicle and also comprises one or more electrical terminals 12 securely and conventionally mounted to the mounting bracket 11 and each having a plurality of first connecting members 16 for connecting to a plug of an electrically-operated device. The one or more electrical terminals 12 also includes a plurality of second connecting members 19 for connecting to a plug of a power source. Each of the one or more electrical terminals 12 includes a housing 13 having a first end 14 and a second end 15 and being adapted to securely support the connecting members 16, 19 therein with the first connecting members 16 being accessible in the first end 14 thereof and the second connecting members 19 being accessible in the second end 15 thereof.

A bracket member 22 conventionally depends from the one or more electrical terminals 12. The bracket member 22 includes a first portion 23 and a second portion 24 which is angled relative to the first portion 23 and which has an opening extending therethrough. The first portion 23 depends from the one or more electrical terminals 12. As a first through the eighth embodiments, the one or more electrical terminals 12 includes the connecting members 16, 19 being spacedly aligned side-by-side essentially in a row with the row being disposed either parallel or perpendicular to the bracket member 22 with the bracket member 22 depending therefrom.

At least one electrical outlet 25 is securely and conventionally mounted to the bracket member 22. The opening in the bracket member 22 is adapted to receive and securely support a first end portion of the at least one electrical outlet 25. At least one cover member 26 is hingedly attached to the bracket member 22 and is coverable upon the at least one electrical outlet 25 and includes a lid and a spring conventionally connected to the lid and to the bracket member 22 for biasing the lid upon the at least one electrical outlet 25. A plurality of wires 27 are conventionally connected to the at least one electrical outlet 25 and is adapted to be connected to a power supply.

For the various embodiments, the connecting members 16, 19 include female-type connecting members 18, 21 for being mateable with plugs having male-type connectors. The connecting members 16, 19 include from four to seven the female-type connecting members 18, 21.

For the various embodiments, the connecting members 16, 19 include male-type connecting members 17, 20 for being mateable with plugs having female-type connectors. The connecting members 16, 19 include from four to seven male-type connecting members 17, 20.

Also, for the various embodiments, the connecting members 16, 19 include one or more female-type connecting members 18, 21 and one or more male-type connecting members 17, 20 for being mateable with plugs having a combination of one or more female-type and male-type connectors.

Further, for the various embodiments, the connecting members 16, 19 are spacedly arranged in a circular pattern and are adapted to mate with a round plug of an electrically-operated device having connectors arranged in a circular pattern with the connecting members 16, 19 including male-type connecting members 17, 20 for being mateable with plugs having female-type connectors. The connecting members 16, 19 include from four to seven the male-type connecting members 17, 20. The housing 13 of each of the one or more electrical terminals 12 is essentially a tubular member with the first 14 and second 15 ends essentially being open. One or more second covers 28 are hingedly attached to the mounting bracket 11 and are biasedly closeable upon the first end 14 of the housing 13 and upon the second end 15 of the housing 13.

In use, the user is able to attach a wide variety of plugs to the power adapter interface apparatus 10 because of the wide variety of electrical terminals 12 and electrical outlets 25. Trailers have different types of plugs, some having all male-type connectors arranged in a row, and some having all female-type connectors arranged in a row, and some having a combination of male-type and female-type connectors arranged in a row, and some being arranged in a circular pattern. The power adapter interface apparatus 10 also allows the user to plug power cords from lighting devices in the electrical outlet 25 so that the user can have access to a light, air compressor, vacuum cleaner, cell phone, and other devices when needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple power adapter interface apparatus comprising:

a housing having a first end and a second end, the second end of said housing forming a power supply plug for removably mounting on an electrical power supply receptacle on a vehicle;

a mounting bracket mounted on said housing towards said first end thereof;

one or more electrical terminals mounted on said housing, each of said one or more electrical terminals having a plurality of first and second connecting members, each of said first connecting member being in electrical communication with one of said second connecting members, each of said second connecting members being positioned at the second end of said housing and forming a portion of said power supply plug;

a bracket member depending from said mounting bracket below said one of more electrical terminals;

at least one electrical outlet socket securely mounted to said bracket member, said at least one electrical outlet socket being in electrical communication with at least one of said one or more electrical terminals for tapping power from said one or more electrical terminals between said pluralities of first and second connecting members, said at least one electrical socket outlet having a cavity configured for receiving a vehicle cigarette-lighter compatible plug in a manner permitting electrical communication between said electrical outlet socket and the cigarette-lighter compatible plug;

wherein each of said first connecting members is positioned at the first end of said housing for connecting to a plug of an electrically-operated device.

2. The apparatus of claim 1, wherein said bracket member includes a first portion and a second portion which is angled relative to said first portion and which has an opening extending therethrough, said opening being adapted to receive and support a first end portion of said at least one electrical outlet-socket.

3. The apparatus of claim 1, additionally comprising at least one cover member being hingedly attached to said bracket member and being positionable over said at least one electrical outlet.

4. The apparatus of claim 3, wherein at least one cover member includes a lid and a flexible link connected to said lid and to said bracket member for retaining said lid in a position adjacent to said at least one electrical outlet socket.

5. The apparatus of claim 1, wherein said first connecting members include female-type connecting members for being mateable with plugs having male-type connectors.

6. The apparatus of claim 5, wherein said first connecting members include male-type connecting members for being mateable with plugs having female-type connectors.

7. The apparatus of claim 6, wherein said first connecting members include from four to seven said male-type connecting members.

8. The apparatus of claim 3, additionally comprising a second cover being hingedly attached to said mounting bracket and being positionable over said at least one electrical outlet.

9. The apparatus of claim 1, wherein said connecting members include male-type connecting members for being mateable with plugs having female-type connectors.

10. The apparatus of claim 1, wherein a portion of said first connecting members are aligned side-by-side in a row to form one said electrical terminal.

11. The apparatus of claim 10, wherein said row is disposed substantially parallel to a longitudinal extent of said mounting bracket.

12. The apparatus of claim 10, wherein said row is disposed substantially perpendicular to a longitudinal extent of said mounting bracket.

13. The apparatus of claim 10, wherein said first connecting members are arranged in a substantially parallel pair of said rows to form two of said electrical terminals.

14. The apparatus of claim 1, wherein said first connecting members include at least one female-type connecting member and at least one male-type connecting member for being mateable with plugs having a combination of each of said female-type and male-type connectors.

15. The apparatus of claim 1, wherein said plurality of second connecting members are arranged in a substantially circular pattern for mating with a round power supply receptacle having connectors arranged in a circular pattern.

16. The apparatus of claim 1, wherein electricity flow at said plurality of second connecting members and said at least one electrical outlet socket is substantially unchanged in voltage from electricity flow into said plurality of first connecting members.

17. The apparatus of claim 1, wherein said at least one electrical outlet socket comprises two electrical outlet sockets.

18. The apparatus of claim 1, wherein said housing has a longitudinal axis and the cavity of said at least one electrical outlet socket has a longitudinal axis, and wherein the longitudinal axis of the cavity of said at least one electrical outlet is substantially parallel to the longitudinal axis of said housing.

19. The apparatus of claim 1, wherein said housing has a longitudinal axis, and wherein said plurality of first and second connecting members and said at least one electrical outlet socket are all oriented substantially parallel to the longitudinal axis of said housing, said first connecting members and said at least one electrical outlet socket being oriented in a first direction and said second connecting members being directed in a second direction opposite to said first direction.

* * * * *